US006431292B2

(12) United States Patent
Mocivnik et al.

(10) Patent No.: US 6,431,292 B2
(45) Date of Patent: Aug. 13, 2002

(54) DEVICE FOR DRILLING AND DRAINING HOLES IN SOIL OR ROCK

(75) Inventors: Josef Mocivnik, Fohnsdorf; Karl Bohm, Ansfelden, both of (AT)

(73) Assignees: Techno Entwicklungs - und Vertriebs GmbH, Fohnsdorf; "Alwag" Tunnelausbau Gellschaft mbH, Pasching, both of (AT)

( * ) Notice: Subject to any disclaimer, the term of this patent is extended or adjusted under 35 U.S.C. 154(b) by 0 days.

(21) Appl. No.: 09/783,099

(22) Filed: Feb. 15, 2001

Related U.S. Application Data

(63) Continuation of application No. PCT/AT99/00207, filed on Aug. 20, 1999.

(30) Foreign Application Priority Data

Aug. 21, 1998 (AT) ..... 1429/98

(51) Int. Cl.[7] ..... E21B 43/34; E21B 10/36; E03B 3/18

(52) U.S. Cl. ..... 175/314; 175/312; 175/414; 166/233

(58) Field of Search ..... 175/293, 314, 175/312, 320, 324, 414; 166/227, 233

(56) References Cited

U.S. PATENT DOCUMENTS

| | | | | | |
|---|---|---|---|---|---|
| 400,466 | A | * | 4/1889 | Lowery et al. | 175/319 |
| 673,398 | A | * | 5/1901 | Keller et al. | 175/19 |
| 717,420 | A | * | 12/1902 | Leeson | 175/19 |
| 2,325,556 | A | | 7/1943 | Taylor, Jr. et al. | 309/4 |
| 2,891,623 | A | | 6/1959 | Boss | 166/205 |
| 3,221,819 | A | | 12/1965 | Dickinson et al. | 166/233 |
| 3,411,321 | A | * | 11/1968 | Schurman | 464/183 |
| 4,068,713 | A | * | 1/1978 | McGuire | 166/233 |
| 4,869,323 | A | | 9/1989 | Stagg | 166/285 |
| 5,078,211 | A | | 1/1992 | Swineford | 166/202 |
| 5,219,028 | A | * | 6/1993 | Martin et al. | 166/380 |
| 5,234,055 | A | * | 8/1993 | Cornette | 166/278 |
| 5,664,628 | A | * | 9/1997 | Koehler et al. | 166/369 |

FOREIGN PATENT DOCUMENTS

| | | |
|---|---|---|
| FR | 2543213 | 9/1984 |
| WO | WO98/21439 | 5/1998 |

* cited by examiner

*Primary Examiner*—David Bagnell
*Assistant Examiner*—Jennifer R. Dougherty
(74) *Attorney, Agent, or Firm*—Jacobson Holman, PLLC

(57) ABSTRACT

The invention relates to a device (1) for the drilling, notably by percussion or rotary-percussion drilling, and draining of holes in soil or rock. A drill bit (2, 3) mounted on a drill rod (4) creates a bore hole and a jacket tube (6) is coupled to the drill rod (4) or the drill bit (2, 3). In the area adjacent to the drill bit (2, 3) the jacket tube (6) has at least one through hole which opens into an annular space embodied between the drill rod and the jacket tube. In the end area adjacent to the drill bit (2, 3) the jacket tube (6) is surrounded by at least one filter tube (7) having a plurality of through holes or slits (8) which are distributed especially evenly across its circumference. This allows for correspondingly safe and reliable drainage during boring, using simple measures.

20 Claims, 2 Drawing Sheets

DEVICE FOR DRILLING AND DRAINING HOLES IN SOIL OR ROCK

The present application is a continuation application of PCT/AT99/00207, filed Aug. 20, 1999.

BACKGROUND OF THE INVENTION

1. Field of the Invention

The present invention relates to a device for drilling, in particular impact drilling or rotary percussion drilling, and draining holes in soil or rock material, wherein a drill bit mounted on a drill rod assembly forms a drill hole and a jacket tube is coupled with the drill rod assembly or the drill bit, wherein the jacket tube in the region following upon the drill bit is formed with at least one passage opening that opens into an annular space formed between the drill rod assembly and the jacket tube.

2. Description of the Prior Art

A device of this type can be taken, for instance, from WO 98/21439, wherein a process and a device for simultaneously drilling and lining holes is disclosed. By means of a jacket tube surrounded by a drill rod assembly actuating a drill bit, an annular space is made available between the jacket tube and the external periphery of the drill rod assembly, wherein, for instance, in the region immediately following upon the drill bit, at least one passage opening is provided in the jacket tube, via which worked material may subsequently be extracted from the drill hole to be produced. Furthermore, it is, of course, possible to extract from the drill hole, through that passage opening, also water present in the immediate region of the drill bit such that dewatering or draining of a bore hole may be effected in the foremost section in the region of the drill bit by that known device. However, when doing so, it is to be anticipated that selective dewatering or draining is impossible not least for the reason that the at least one passage opening provided in the region immediately following upon the drill bit serves to remove the worked material and, therefore, must have an accordingly large cross section naturally unable to provide for the respective filter effect required in draining.

A modified embodiment of a device of the type mentioned-above can be taken, for instance, from FR-A 2 543 213, wherein a drill rod is surrounded by a jacket tube and within the drill rod there is provided in the leading part a further tubelike component being provided with openings. Furthermore there should be provided a mat-like filtering element, for instance.

From U.S. Pat. No. 2,891,623 there has become known a device and a tool for providing and maintaining a respective filtering effect of a well, which differs essentially from the intended use and operation of a device according to the type mentioned-above. Similarily perforated tubes or elements for usage in the construction of a well can be taken from U.S. Pat. Nos. 3,221,819 and 4,869,323.

SUMMARY OF THE INVENTION

The present invention, thus, aims at providing a device of the initially defined kind, which renders feasible not only the drilling, in particular impact drilling or rotary percussion drilling, of a bore hole, but, if desired, additionally enables the selective dewatering or drainage of the rock material surrounding the drilling, in particular upon completion of the drill hole.

To solve this object, the device for drilling, in particular impact drilling or rotary percussion drilling, and draining holes in soil or rock material according to the invention, departing from a device of the initially mentioned kind, essentially is characterized in that the jacket tube, in the end region following upon the drill bit, is surrounded by at least one filtering tube formed with a plurality of passage openings or slits arranged distributedly about its circumference, particularly in a uniform manner and that the jacket tube is free of passage openings over a partial region, for instance about one third, of its circumference. Due to the fact that, according to the invention, besides the jacket tube, which is formed with at least one passage opening in the region following upon the drill bit, an additional filtering tube surrounding the jacket tube is provided, draining or dewatering of soil or rock material surrounding the drill hole is feasible both during the drilling procedure and also subsequent to the formation of a drill hole selectively and, in particular, over a large length of the drill hole. By arranging and forming as well as dimensioning the passage openings or passage slits in the at least one filtering tube in an appropriate manner, a suitable filter effect may be obtained, whereby only fluid to be drained after filtering is introduced into the annular space or clearance defined by the jacket tube and the drill rod assembly and removed from the drill hole. This filter effect over a large length of the drilling also may be maintained, for instance, after the removal of the drill rod assembly with parts of the drill bit. Due to the fact that according to the invention it is further provided that the jacket tube is free of passage openings over a partial region, for instance about one third, of its circumference, by arranging the passage-opening-free region of the jacket tube, which is subjected merely to tensile stresses and not to torsional stresses, in the lower region of the drill hole, it is thus prevented that fluid to be received and removed enters the upper region of the jacket tube and again leaves the interior of the jacket tube in the lower region such that the safe drainage of fluid present in the interior of the jacket tube will be ensured even with bores extending obliquely upwards.

In order to enable a substantially uniform filter effect over the entire periphery of the filtering tube as well as the jacket tube surrounded by the filtering tube, it is contemplated according to a preferred embodiment of the invention that the filtering tube surrounds the jacket tube while forming a further annular space.

In order to enable the proper passage through the filtering tube of the liquid to be drained, it is provided that the annular space formed between the external circumference of the jacket tube and the internal diameter of the filtering tube has a clear passage width of at least 1 mm and, in particular, about 1.5 mm, as in correspondence with a further preferred embodiment of the device according to the invention. Such a clear passage cross section or dimensioning of the annular space provided between the external circumference of the jacket tube and the internal circumference of the filtering tube usually will be sufficient to enable the proper drainage of the fluid to be drained into the interior of the jacket tube, while simultaneously ensuring that no excessive enlargement, or no enlargement at all, of the drill hole diameter or drill hole cross section will be become necessary during the production of the drill hole in order to take into account the additional dimensions of the jacket-tube-surrounding filtering tube to be inserted so as to avoid any additional extra expense for realizing a bore.

If the arrangement of one or several filtering tubes over a larger longitudinal extension of the jacket tube in the region following upon the drill bit is desired, it is, moreover, provided in a preferred manner that the annular space is defined by spacers arranged between the jacket tube and the filtering tube and/or by sleeve elements provided, in particular, in the end regions of the filtering tube such that the annular space required between the jacket tube and the filtering tube for a proper filter effect even over larger lengths of a filtering section will be safely maintained.

In order to prevent the annular space provided between the filtering tube and the jacket tube from being obstructed by worked rock eventually introduced along with the fluid to be drained, it is, moreover, suggested that the filtering tube over its circumference is formed with respectively equidistant passage slits each having a width of about 0.5 mm to about 1 mm, as in correspondence with a further preferred embodiment of the device according to the invention.

In particular, when providing a filtering tube having a larger longitudinal extension or when providing several contiguous filtering tubes in order to be able to provide an accordingly long draining or dewatering path, it is contemplated according to another preferred embodiment that the jacket tube in its section surrounded by the filtering tube is provided with a plurality of passage openings arranged distributedly about its circumference, particularly in a uniform manner, the clear width of which passage openings exceeds the clear width of the passage openings or slits formed in the filtering tube so as to enable an accordingly safe extraction of the fluid through the annular space provided between the jacket tube and the drill rod assembly. By dimensioning the passage openings or slits on the circumference of the jacket tube accordingly larger, the possibility of an immediate transportation of the fluid will, moreover, be ensured even when providing a smaller amount of passage openings or slits. Obstruction of the passage openings or slits provided in the jacket tube need not be feared in that case, since the filtering tube is designed with accordingly smaller passage openings or slits so that the entry of larger particles need not be feared. Furthermore, it is also feasible by an appropriate distribution of the passage openings or slits in the jacket tube to devise the configuration in a manner that no excessive weakening of the mechanical strength or resistance of the jacket tube need be feared.

In this context, it is contemplated according to a preferred embodiment that the passage openings of the jacket tube are formed along axial generatrices of the jacket tube and in the circumferential direction each extend substantially in a plane normal to the longitudinal axis of the jacket tube. On the circumference of the jacket tube in the axial direction will consequently remain regions in which no passage openings are provided such that the jacket tube will be able to safely absorb the tensile stresses acting thereupon even in case of possibly lower material thicknesses.

According to a further modified embodiment of the invention, it is suggested in a preferred manner that the jacket tube, on its surface facing the filtering tube, is corrugated or provided with rib-shaped elevations, on which the filtering tube is supportable at least over part of its circumference so as to ensure the simultaneous safe support of the filtering tube on the external circumference of the jacket tube with an accordingly rigid design of the jacket tube.

In order to assist any desired drainage, it is suggested according to a further preferred embodiment that a sealing element is provided on the external circumference of the jacket tube at a distance from the filtering tube on the end facing away from the drill bit and that in the jacket tube, on the end facing away from the filtering tube, at least one outlet opening for delivering a filling mass, in particular a hardening suspension, is provided in the vicinity of the sealing element. By means of such a sealing element, which enables the sealing of a drill hole relative to surrounding rock, in particular upon delivery of the filling mass, in particular a hardening suspension such as, for instance, concrete or the like, not only the path or length of the drill hole provided for draining will be precisely defined, but such sealing also prevents fluid possibly present in the region of the drill bit from spreading within the drill hole along the external side of the jacket tube, thereby causing, for instance, the flushing, or undesired enlargement of the dimensions, of the drill hole as might be feared, for instance, at the occurrence of water with a roof bolt to be set in a roof, in which case the drill hole opening extends inclinedly downwards and fluid present in the rock could flow off outside the jacket tube.

In order to enable accordingly simple sealing, the configuration preferably is devised such that the sealing element is comprised of a lip-shaped or tongue-shaped synthetic element annularly surrounding the jacket tube and capable of being widened upon introduction of the filling mass, wherein, in this respect, it is, furthermore, suggested in a preferred manner that the sealing element is formed with a hardness of 80 to 100 Shore and, in particular, 90 Shore. While maintaining a suitable mechanical strength or resistance of the sealing element, this also results in the respective elasticity allowing for proper widening, and hence abutting of the sealing element on the wall of the produced drill hole, upon introduction of a filling mass.

According to a modified embodiment, it is preferably suggested according to the invention that the sealing element is provided in the region following upon the filtering tube, whereby it is feasible by the aid of the sealing element and the subsequent introduction of a filling mass to obtain a suitable sealing effect and anchorage of the lining-forming jacket tube consecutive to the filtering tube. If the position of the soil or rock layer to be drained is not exactly known, an accordingly larger distance may be provided between the end of the filtering tube and the sealing element.

For further assisting the sealing function, in particular of the widenable sealing element, or for selectively widening the sealing element, it is provided that an annular sleeve element surrounding the jacket tube and preferably displaceable along the jacket tube cooperates with the sealing element, as in correspondence with a further preferred embodiment of the device according to the invention.

In particular with drillings in loose rock or in rock layers of varying compositions, partial enlargements of the drill hole diameters may optionally result from deviations from the optimum drilling direction, which in some cases may not be completely compensated for or reliably sealed by the sealing element. In this context, it is, therefore, contemplated in a preferred manner that a packer, in particular a packer inflatable by compressed air, surrounds the jacket tube in a manner immediately preceding the sealing element. By means of such a packer even larger deviations from the optimum drill hole cross section may be reliably sealed at least as a precaution, whereby, in combination with the sealing element and the filling mass to be introduced, sealing aimed at a proper drainage may subsequently be accomplished.

In case automatic draining and, in particular, draining as complete as possible cannot be expected even with bores directed upwards from the horizontal, due to the presence of reduced amounts of fluid contained in the rock material, it is contemplated according to a further preferred embodiment that a suction pump or a negative pressure or vacuum source is connectable to the jacket tube on its end facing away from the drill bit, whereby it is feasible, upon introduction of the filling mass with the sealing element sitting close, to ensure selective dewatering of the drill hole and of the surrounding rock material by a suitable suction pump or negative pressure source.

In order to do with thin-walled jacket tubes which do not have to resist excessive loads and via which, in particular, no drive or impact actions are to be transmitted onto the drill bit, it is proposed that the jacket tube, in a manner known per se, under tensile actuation is coupled with the drill bit, optionally with a coupling element arranged therebetween, in particular an impact shoe acting on the drill bit, as in correspondence with a further preferred embodiment of the device according to the invention. In this context, it is, moreover, provided in a preferred manner that the jacket tube is made of steel and the filtering tube, which is not subjected to any loads, is made of a synthetic material, whereby such a material combination provides sufficient stability and durability for the jacket tube and the filtering tube and, at the same time, by the filtering tube being made of a synthetic material, any additional mass and also the required additional enlargement of the external circumference in the region immediately adjacent the drill bit are limited to a minimum.

SHORT DESCRIPTION OF THE DRAWINGS

In the following, the invention will be explained in more detail by way of exemplary embodiments schematically represented in the accompanying drawing. Therein:

Figure 1:
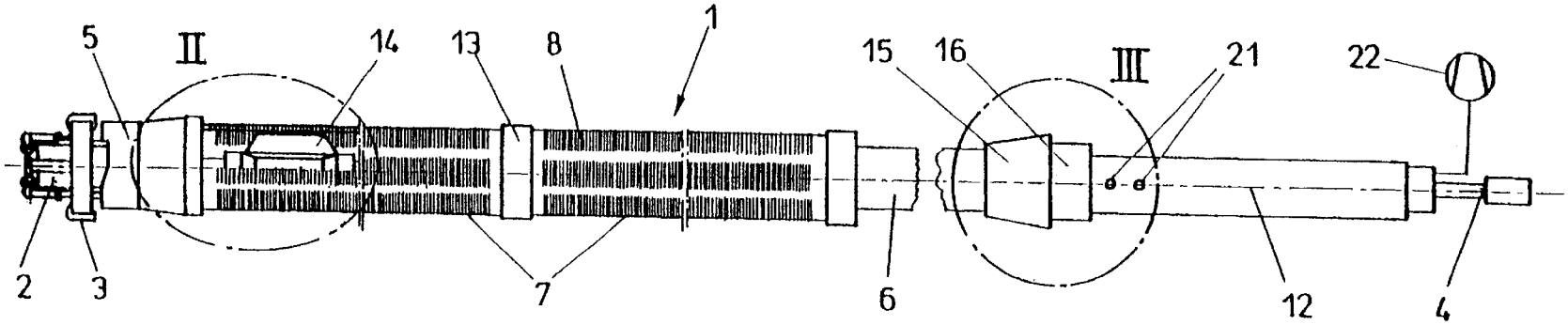
FIG. 1 is a partially sectioned schematic illustration of a device according to the invention for drilling and draining holes in soil or rock material.
Figure 3:
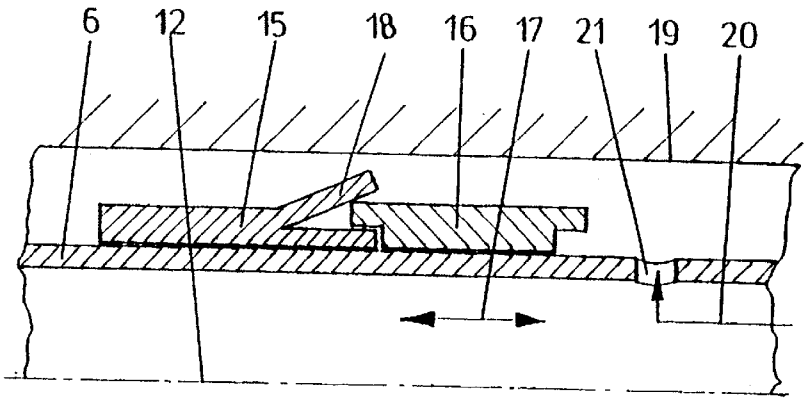
Figure 4:
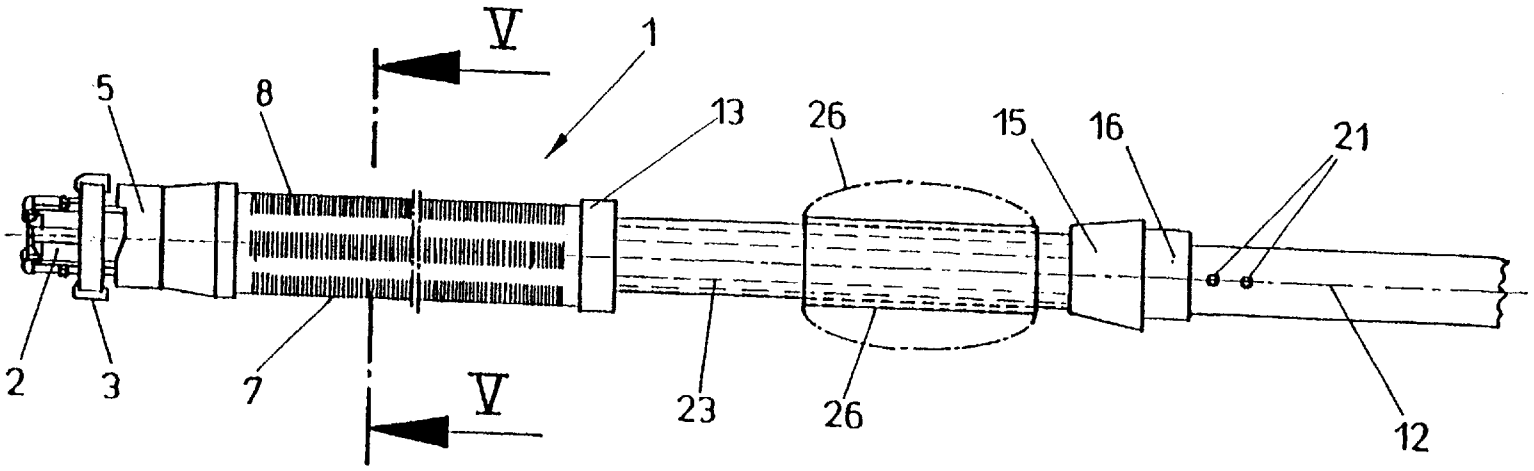
Figure 5:
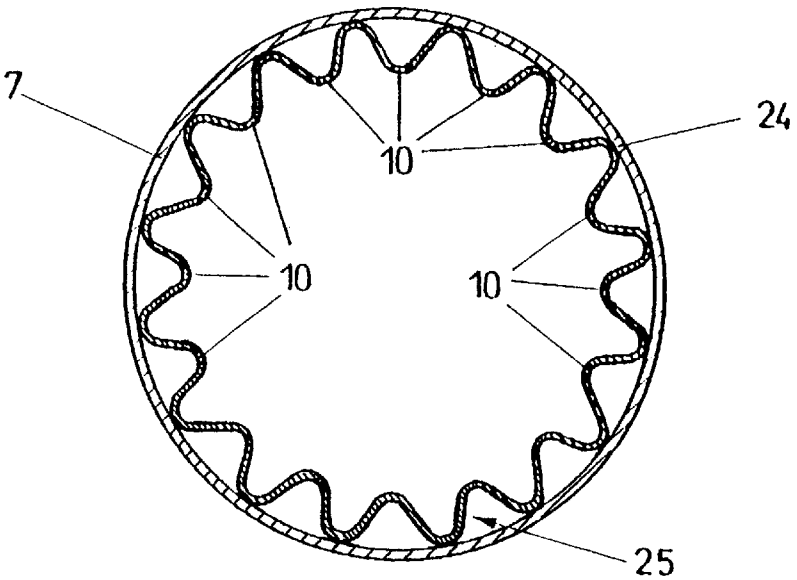

FIG. 3 also on an enlarged scale shows the partial region III of FIG. 1, again partially sectioned;

FIG. 4 in a representation similar to FIG. 1 shows a modified embodiment of a device according to the invention; and FIG. 5 is a section along line V—V of FIG. 4 on an enlarged scale.

DETAILED DESCRIPTION OF PREFERRED EMBODIMENTS OF THE INVENTION

In FIG. 1, a device for drilling, in particular impact drilling or rotary percussion drilling, and draining holes in soil or rock material is generally denoted by 1, wherein a drill bit, which is divided into a central drill bit 2 and an annular drill bit 3, for instance, in the radial direction, in a known manner is actuated for impact drilling or rotary percussion drilling via a drill rod assembly schematically indicated by 4. The drill bit, in addition, cooperates with an impact shoe 5, wherein the drill rod assembly 4 is surrounded by a jacket tube 6 composed of several individual parts, as will be apparent even more clearly from FIGS. 2 and 3.

In the region immediately following upon the drill bit 2, 3 and the impact shoe 5, respectively, a filtering tube 7 surrounding the jacket tube 6 and composed of a plurality of individual parts in the shown representation is provided, which comprises a plurality of passage openings or passage slits 8 distributed about its periphery, particularly in a uniform manner.

As is apparent, in particular, from the enlarged illustration according to FIG. 2, fluid to be drained, via passage slits 8 provided in the filtering tube 7, reaches an annular space or clear space 9 formed between the external periphery of the jacket tube 6 and the internal periphery of the filtering tube 7, whereupon, in the following, the entering fluid or water to be drained, via passage openings 10 provided on the jacket tube 6 at least in the region of the section surrounding the filtering tube 7, gets into the interior of an annular space 11 defined between the external diameter of the drill rod assembly again denoted by 4 and the internal diameter of the jacket tube 6. Thus, an appropriate filter effect is obtained through the filtering tube 7 via the passage slits 8, which have a width of, for instance, approximately 0.5 mm to approximately 1 mm, whereupon the subsequenty safe transport of fluid to be drained is effected via the annular space 11 between the drill rod assembly 4 and the jacket tube 6 through the passage openings 10 provided in the jacket tube 6 and having larger dimensions or clear passage widths.

Moreover, the central axis of the device 1 is indicated by 12 in the Figures.

Figure 2:
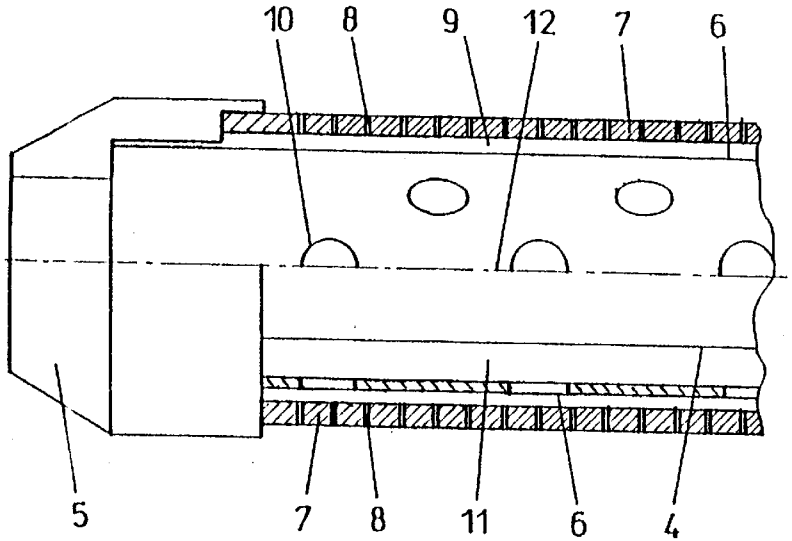
FIG. 2 shows the partial region II of FIG. 1 partially sectioned and on an enlarged scale.

In order to maintain a suitable annular space or clear space 9 between the jacket tube 6 and the filtering tube 7, spacers and, in particular in the end regions of the filtering tube or filtering tube section, sleeve elements are, moreover, provided, which are schematically indicated by 13 in FIG. 1, wherein, in the region immediately following upon the impact shoe 5, a guiding sleeve 14 is additionally provided, which likewise i.a. serves to maintain a suitable annular or clear space 9 between the filtering tube 7 and the jacket tube 6, said additional guiding sleeve not being illustrated in FIG. 2.

Moreover, a sealing element 15 is provided at a distance from the filtering tube 7 for appropriate sealing and, hence, possible elevated dewatering and drainage effects, which sealing element surrounds the jacket tube 6, or a jacket tube section, wherein, in addition, a sleeve element 16 likewise surrounding the jacket tube 6 cooperates with the sealing element 15, as is illustrated in more detail in FIG. 3.

From FIG. 3 it is apparent that the sealing element 15 is an at least partially lip-shaped or tongue-shaped synthetic element surrounding the jacket tube 16, wherein the extent of widening of the part constituting a leg or tongue 18, of the sealing element 15 may be respectively chosen, for instance, by displacing the sleeve element 16 in the sense of the double arrow 17.

When performing drilling, it is desirable that the free end of the tongue or lip 18 does not contact the drill hole wall schematically indicated by 19 such that drillings or worked material may optionally be conducted past the sealing element 15. If a sealing effect is to be achieved, widening of the tongue or lip 18, on the one hand may be effected by displacing the sleeve 16 in the direction towards the sealing element 15. Widening and final abutting of the free end of the lip or tongue 18 is assisted by introducing into the free space surrounding the jacket tube 6 between the jacket tube 6 and the drill hole wall 19 a hardening suspension or, in general, a filling mass via at least one outlet opening 21 along arrow 20, thereby obtaining a sealing closure in the region adjacent the sealing element 15 by the aid of the filling mass with the free end of the lip or tongue 18 sitting close.

After having produced a seal in the region of the sealing element 15, a negative pressure source or suction pump, which is schematically indicated by 22 in FIG. 1, may subsequently be applied at the annular space 11 defined between the jacket tube 6 and the drill rod assembly 4 so as to be able to effect the suction or drainage of fluid that gets, or is sucked, into the interior of the free space 11 via the filtering tube 7 and the passage openings 10.

Depending on the circumstances, the positioning of the sealing element 15 may be chosen such that, for instance, sealing is effected adjacent the filtering path 7.

In order to obtain the respective mechanical strength, the jacket tube 6 may be made of steel, while the filtering tube or filtering tube sections 7 may be comprised of a synthetic material.

In the embodiment represented in FIGS. 4 and 5, the reference numerals of the preceding Figures have been retained for identical elements. Again, a filtering tube 7 comprising a plurality of passage slits 8 and surrounding the jacket tube 23 is arranged to follow the drill bit 2, 3 and the impact shoe 5, respectively, wherein the jacket tube 23 is provided with a corrugated or ribbed surface enabling the enhancement of the rigidity and resistance of the jacket tube while simultaneously allowing the filtering tube 7 to be supported on the respective elevations 24. In the depressions passage openings 10 are again respectively provided, through which fluid introduced via the filtering tube 7 may be delivered into the interior of the jacket tube 23 and, further on, out of the jacket tube 23. The jacket tube 23, furthermore, is free of passage openings over a partial region extending over the lower third 25 such that in case of obliquely extending bores the safe entry of fluid into the interior of the jacket tube 23 through the passage openings 10 is rendered feasible in the upper region while avoiding an undesired exit from the lower region 25, which, in turn, would cause its penetration back into the rock. By arranging the passage openings 10 along axial generatrices with circumferential regions remaining free of passage openings, an accordingly resistant structure of the jacket tube 23 is, moreover, maintained.

It goes without saying that also the jacket tube 6 of FIGS. 1 to 3 may be designed to have a substantially smooth outer contour with passage openings 10 merely arranged along axial generatrices and, for instance, its lower region free of openings 10.

Besides the sealing element 15 following upon the filtering region 7, which is similar to the preceding configuration, FIG. 4 additionally depicts an optionally employable packer 26 preceding the sealing element 15. Such a packer 26, which is widenable, for instance, by compressed air, may offer an additional, at least provisional, sealing, in particular in those cases in which the sealing element 15 alone will not do with drillings unable to be controlled in a totally precise manner and with optionally widened drill hole diameters. A widened packer position capable of being reached is indicated 26' in FIG. 4.

Moreover, draining and filtering effects may be maintained by providing the filtering tube 7 surrounding the jacket tube 6 or 23, respectively, even after having removed the drill rod assembly 4 with parts of the drill bit 2 from the drill hole 19.

What is claimed is:

1. A device for drilling and draining holes in soil or rock material, comprising: a drill bit mounted on a drill rod assembly for forming a drill hole, a jacket tube coupled with the drill rod assembly, the jacket tube in a region following upon the drill bit is formed with at least one passage opening that opens into an annular space formed between the drill rod assembly and the jacket tube, the jacket tube, in an end region following upon the drill bit, is surrounded by at least one filtering tube formed with a plurality of passage openings or slits arranged distributedly about its circumference, in a uniform manner and the jacket tube is free of passage openings over a partial region being defined as about one third of its circumference.

2. The device according to claim 1, wherein the filtering tube surrounds the jacket tube while forming a second annular space.

3. The device according to claim 2, wherein the second annular space formed between the external circumference of the jacket tube and the internal diameter of the filtering tube has a clear passage width of at least 1 mm.

4. The device according to claim 2, wherein the second annular space is defined by spacers arranged between the jacket tube and the filtering tube in the end regions of the filtering tube.

5. The device according to claim 2, wherein the second annular space is defined by spacers arranged between the jacket tube and the filtering tube and by sleeve elements provided in the end regions of the filtering tube.

6. The device according to claim 2, wherein the second annular space is defined by spacers arranged between the jacket tube and by sleeve elements provided in the end regions of the filtering tube.

7. The device according to claim 1, wherein the filtering tube over its circumference is formed with respectively equidistant passage slits each having a width of about 0.5 mm to about 1 mm.

8. The device according to claim 1, wherein the jacket tube in a section surrounded by the filtering tube is provided with a plurality of passage openings arranged distributedly about its circumference, in a uniform manner, wherein the clear width of the passage openings in the jacket tube exceeds the clear width of the passage openings or slits formed in the filtering tube.

9. The device according to claim 8, wherein the passage openings of the jacket tube are formed along axial generatrices of the jacket tube and in the circumferential direction each extended substantially in a plane normal to the longitudinal axis of the jacket tube.

10. The device according to claim 1, wherein the jacket tube, on its surface facing the filtering tube, is corrugated or provided with rib-shaped elevations, on which the filtering tube is supportable at least over part of its circumference.

11. The device according to claim 1, wherein a suction pump or a negative pressure or vacuum source is connectable to the jacket tube on its end facing away from the drill bit.

12. The device according to claim 1, wherein the jacket tube is made of steel and the filtering tube is made of a synthetic material.

13. A device for drilling and draining holes in soil or rock material, comprising: a drill bit mounted on a drill rod assembly for forming a drill hole, a jacket tube coupled with the drill rod assembly, the jacket tube in a region following upon the drill bit and is formed with at least one passage opening that opens into an annular space formed between the drill rod assembly and the jacket tube, the jacket tube, in an end region following upon the drill bit, is surrounded by at least one filtering tube formed with a plurality of passage openings or slits arranged distributedly about its circumference, in a uniform manner and the jacket tube is free of passage openings over a partial region being defined as about one third of its circumference, a sealing element is provided on the external circumference of the jacket tube at a distance from the filtering tube on the end facing away from the drill bit and that in the jacket tube, on the end facing away from the filtering tube, at least one outlet opening for delivering a filling mass in the vicinity of the sealing element.

14. The device according to claim 13, wherein the sealing element is comprised of a lip-shaped or tongue-shaped synthetic element annularly surrounding the jacket tube and capable of being widened upon introduction of the filling mass.

15. The device according to claim 13, wherein the sealing element is formed with a hardness of 80 to 100 Shore.

16. The device according to claim 13, wherein the sealing element is provided in the region following the filtering tube.

17. The device according to claim 13, wherein an annular sleeve element surrounding the jacket tube and displaceable along the jacket tube cooperates with the sealing element.

18. The device according to claim 13, wherein a packer, inflatable by compressed air, surrounds the jacket tube immediately preceding the sealing element.

19. The device according to claim 13, wherein the filling mass is a hardening suspension.

20. A device for drilling and draining holes in soil or rock material, comprising: a drill bit mounted on a drill rod assembly for forming a drill hole, a jacket tube coupled with the drill rod assembly, the jacket tube in a region following upon the drill bit and is formed with at least one passage opening that opens into an annular space formed between the drill rod assembly and the jacket tube, the jacket tube, in an end region following upon the drill bit, is surrounded by at least one filtering tube formed with a plurality of passage openings or slits arranged distributedly about its circumference, in a uniform manner and the jacket tube is free of passage openings over a partial region being defined as about one third of its circumference, the jacket tube, under tensile actuation, is coupled with the drill bit.

* * * * *